US011053632B2

(12) United States Patent
Yu et al.

(10) Patent No.: US 11,053,632 B2
(45) **Date of Patent: *Jul. 6, 2021**

(54) DRYER APPLIANCE AND IMPELLER HOUSING

(71) Applicant: Haier US Appliance Solutions, Inc., Wilmington, DE (US)

(72) Inventors: Zhiquan Yu, Mason, OH (US); Pablo Enrique Soto Rodriquez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,596

(22) Filed: Jul. 12, 2019

(65) Prior Publication Data

US 2021/0010194 A1 Jan. 14, 2021

(51) Int. Cl.

| | |
|---|---|
| ***D06F 58/20*** | (2006.01) |
| ***D06F 58/10*** | (2006.01) |
| ***F04D 29/28*** | (2006.01) |
| ***D06F 58/02*** | (2006.01) |

(52) U.S. Cl.

CPC ..... *D06F 58/206* (2013.01); *D06F 58/10* (2013.01); *F04D 29/281* (2013.01); *D06F 58/02* (2013.01); *D06F 2204/10* (2013.01)

(58) Field of Classification Search

CPC ..... D06F 58/206; D06F 58/10; D06F 58/02; D06F 2204/10; F04D 29/281

USPC ..... 34/433, 595–610

See application file for complete search history.

(56) References Cited

U.S. PATENT DOCUMENTS

| | | | | |
|---|---|---|---|---|
| 4,389,158 | A * | 6/1983 | Nakanishi | F02C 7/042 415/148 |
| 7,024,802 | B2 | 4/2006 | Myung | |
| 8,333,019 | B2 * | 12/2012 | Gossel | D06F 58/04 34/604 |
| 2008/0022552 | A1 * | 1/2008 | Forget | F04D 29/263 34/602 |
| 2018/0051409 | A1 * | 2/2018 | Yu | D06F 58/20 |
| 2019/0017217 | A1 * | 1/2019 | Kim | D06F 39/04 |
| 2019/0071807 | A1 * | 3/2019 | Vir | D06F 33/00 |

FOREIGN PATENT DOCUMENTS

| | | | | |
|---|---|---|---|---|
| CA | 2554497 C | * | 2/2010 | D06F 58/20 |
| CN | 101349287 B | | 10/2012 | |
| EP | 2527523 B1 | | 2/2014 | |

* cited by examiner

*Primary Examiner* — Stephen M Gravini
(74) *Attorney, Agent, or Firm* — Dority & Manning, P.A.

(57) ABSTRACT

A dryer appliance, as provided herein, may include a cabinet, a drum, a motor, an impeller, and a housing. The motor may be mounted within the cabinet. The impeller may be in mechanical communication with the motor to motivate rotation of the impeller about an axial direction. The impeller may be rotatable about the axial direction to urge a flow of air from the chamber of the drum to a vent of the cabinet. The housing may include a front panel and a rear panel. The front panel and the rear panel may be spaced apart along the axial direction by a housing cavity within which the impeller is positioned. The front panel may define an entrance upstream of the impeller. The rear plate may define a circular groove may extend rearward from the housing cavity and be concentrically aligned with a circumferential perimeter of the impeller.

17 Claims, 9 Drawing Sheets

DRYER APPLIANCE AND IMPELLER HOUSING

FIELD OF THE INVENTION

The present subject matter relates generally to dryer appliances and more particularly to impeller housings for dryer appliances.

BACKGROUND OF THE INVENTION

Dryer appliances generally include a cabinet with a drum rotatably mounted therein. A motor can selectively rotate the drum during operation of the dryer appliance (e.g., to tumble articles located within a chamber defined by the drum). Dryer appliances also generally include a heater assembly that passes heated air through the chamber of the drum in order to dry moisture laden articles disposed within the chamber.

In order to circulate heated air, certain dryer appliances include an impeller to rotate about a drive rod within a housing. During operation of the dryer appliance, the impeller urges a flow of heated air into the chamber of the drum. Such heated air absorbs moisture from articles disposed within the chamber. The impeller also urges moisture laden air out of the chamber through a vent. The vent can be connected to household ductwork that directs the moisture laden air outdoors.

Dryer performance is often affected by impeller size and proximity to the housing within which the impeller is mounted. Thus, a size of the impeller can be increased in order improve dryer performance. However, space with a dryer appliance is generally limited or constrained. Moreover, deflection of the drive rod can be transferred to or magnified at the impeller. For instance, a moment acting perpendicular to the drive rod or axis of rotation may pivot the impeller. In some instances the impeller may even strike an interior surface of the housing, detrimentally affecting performance or life of the impeller. Although mounting an impeller in close proximity to the housing may help ensure the impeller's rotational energy is transferred to the airflow through the housing, this may also increase the risk that the impeller will strike the interior surface of the housing. As a result, managing a size or housing for the impeller can be difficult.

Certain dryer appliances include a second motor configured to rotate the impeller to improve dryer performance. However, motors can be expensive, and adding the second motor to the dryer appliance can increase the cost of the dryer appliance.

Accordingly, a dryer appliance with features for improving air flow through the dryer appliance would be useful. In particular, a dryer appliance with features for improving air flow through the dryer appliance while preventing an impeller from striking a housing for the same would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, a motor, an impeller, and a housing. The cabinet may define a vent. The drum may be rotatably mounted within the cabinet. The drum may define a chamber for receipt of articles for drying. The motor may be mounted within the cabinet. The impeller may be in mechanical communication with the motor to motivate rotation of the impeller about an axial direction. The impeller may be rotatable about the axial direction to urge a flow of air from the chamber of the drum to the vent of the cabinet. The impeller may define a circumferential perimeter about the axial direction. The housing may be positioned within the cabinet. The housing may include a front panel and a rear panel. The front panel and the rear panel may be spaced apart along the axial direction by a housing cavity within which the impeller is positioned. The front panel may define an entrance upstream of the impeller to permit air therethrough. The rear plate may define a circular groove may extend rearward from the housing cavity and be concentrically aligned with the circumferential perimeter of the impeller.

In another exemplary aspect of the present disclosure, a ventilation assembly for a dryer appliance. The ventilation assembly may include a motor, an impeller, and a housing. The impeller may be in mechanical communication with the motor to motivate rotation of the impeller about an axial direction. The impeller may be rotatable about the axial direction to urge a flow of air from a drum of the dryer appliance, the impeller defining a circumferential perimeter about the axial direction. The housing may include a front panel and a rear panel. The front panel and the rear panel may be spaced apart along the axial direction by a housing cavity within which the impeller is positioned. The front panel may define an entrance upstream of the impeller to permit air therethrough. The rear plate may define a circular groove extending rearward from the housing cavity and concentrically aligned with the circumferential perimeter of the impeller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
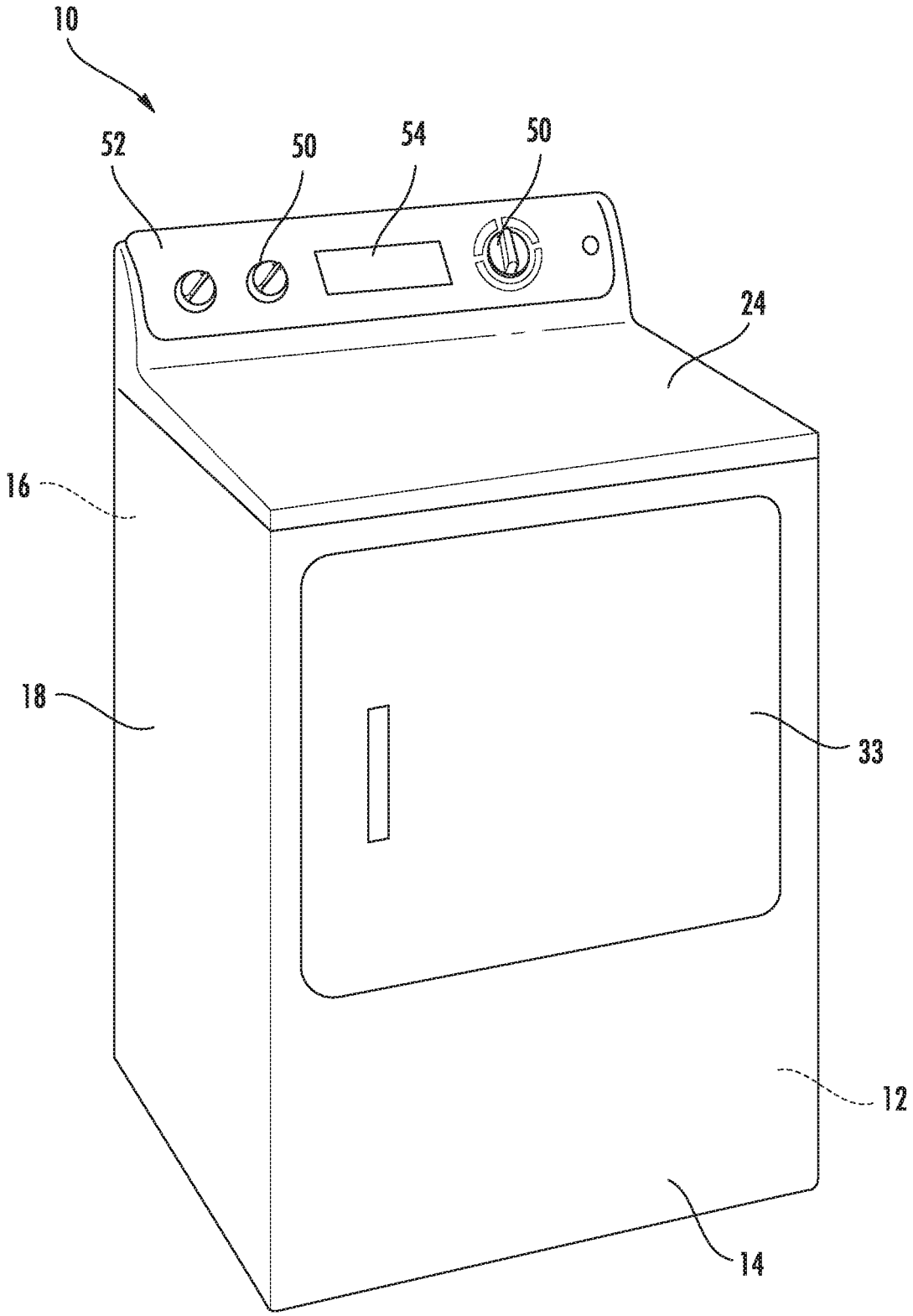
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "article" may refer to but need not be limited to fabrics, textiles, garments (or clothing), and linens.

Figure 2:
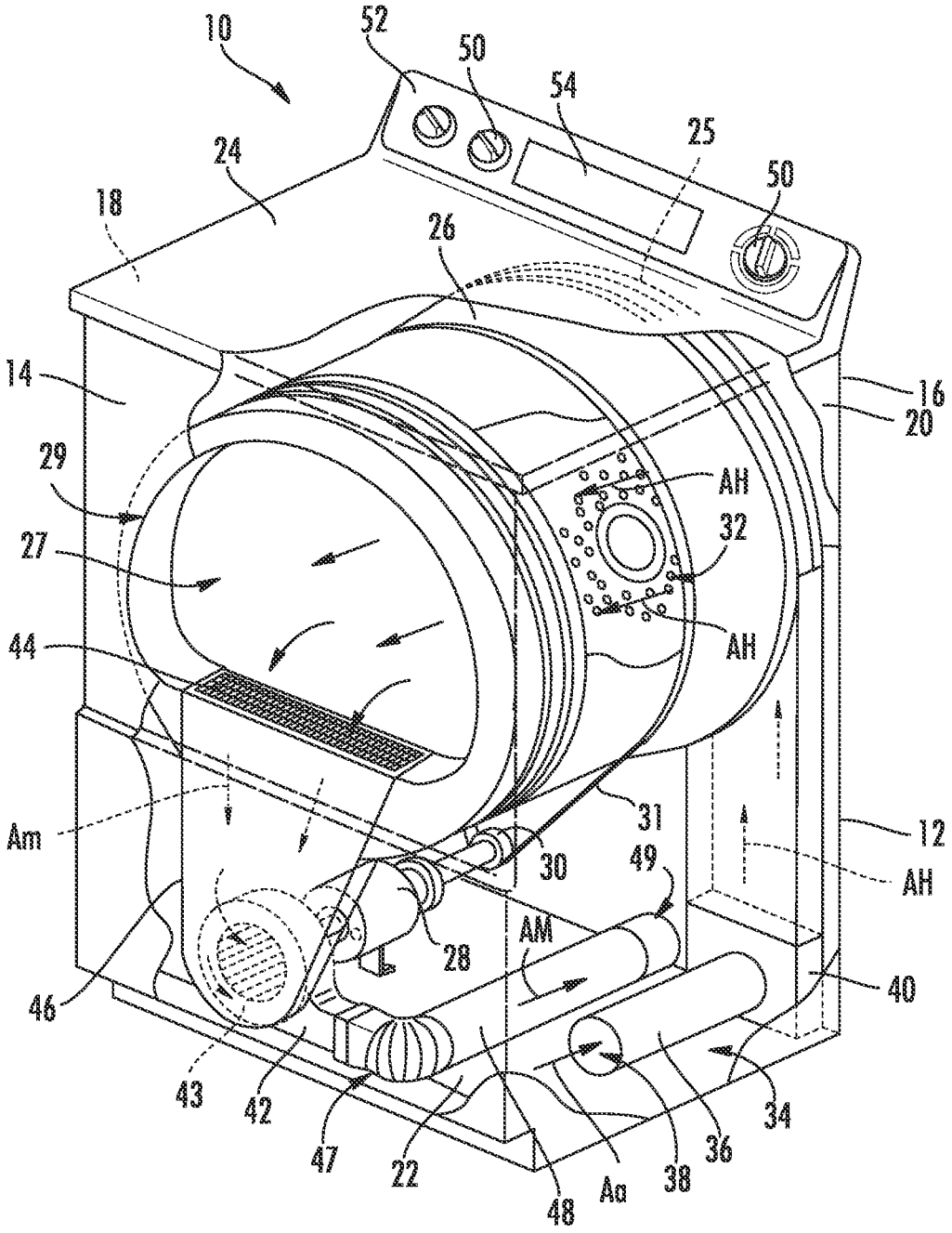
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to an exemplary embodiment of the present disclosure. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, dryer appliance 10 may be an electric dryer appliance with electric heating elements replacing combustion chamber 36.

Dryer appliance 10 generally includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation (e.g., about a substantially horizontal axis). Drum 26 is generally cylindrical in shape and defines a chamber 27 for receipt of articles for drying.

Drum 26 also defines an opening 29 for permitting access to the chamber 27 of drum 26. Opening 29 of drum 26, for example, permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. In some embodiments, a motor 28 is provided in mechanical communication with the drum 26 (e.g., motivate rotation of the drum 26). For example, the motor 28 may rotate the drum 26 about the horizontal axis through a pulley 30 and a belt 31. In additional or alternative embodiments, the motor 28 is part of a ventilation assembly. For example, the motor 28 may be in mechanical communication with a fan or air handler 42 such that motor 28 rotates an impeller 43 (e.g., a centrifugal impeller) of air handler 42. Air handler 42 is configured for drawing air through chamber 27 of drum 26 (e.g., in order to dry articles located therein), as discussed in greater detail below.

During use, drum 26 may receive heated air that has been heated by a heater assembly 34 (e.g., in order to dry damp articles disposed within chamber 27 of drum 26). In some embodiments, heater assembly 34 includes a combustion chamber 36. As discussed above, during operation of dryer appliance 10, motor 28 rotates drum 26 and impeller 43 of air handler 42 such that air handler 42 draws air through chamber 27 of drum 26 when motor 28 rotates impeller 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26. The heated air $A_h$ enters drum 26 through a plurality of holes 32 defined in rear wall 25 of drum 26.

Within chamber 27, the heated air $A_h$ can accumulate moisture, such as from damp articles disposed within chamber 27. In turn, air handler 42 draws moisture laden air, shown as arrow $A_m$, through a screen filter 44 which traps lint particles. Such moisture laden air $A_m$ then enters a front duct 46 and is passed through air handler 42 to an exhaust duct 48. From exhaust duct 48, such moisture laden air $A_m$ passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$ to exit dryer appliance 10. Air handler 42 is in fluid communication with conduit 47, and impeller 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements such as, for example, electrically erasable, programmable read only memory (EEPROM).

Figure 3:
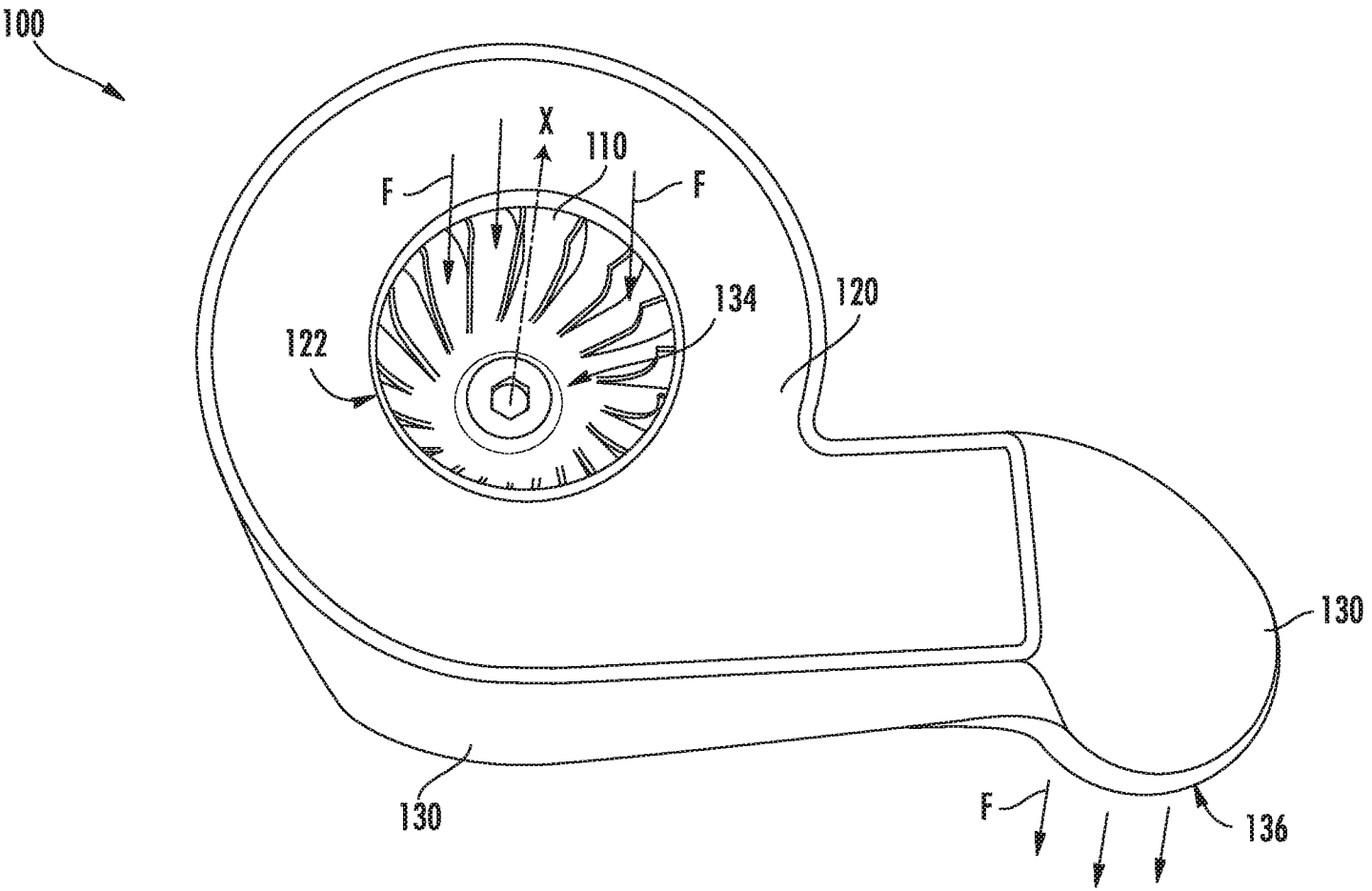
FIG. 3 provides a perspective view of an impeller assembly for a dryer appliance according to exemplary embodiments of the present disclosure.

FIG. 3 provides a perspective view of an impeller assembly 100 of a ventilation assembly according to exemplary embodiments of the present disclosure. Generally, impeller assembly 100 includes an impeller 110 and a housing 112. Impeller assembly 100 may be used in any suitable appliance. For example, impeller assembly 100 may be used in dryer appliance 10 (e.g., as air handler 42—FIG. 2). Thus, impeller assembly 100 may be positioned within cabinet 12 (e.g., at front duct 46) such that impeller assembly 100 draws and receives moisture laden air $A_m$ from chamber 27 of drum 26. As discussed in greater detail below, impeller assembly 100 includes features for limiting or preventing the impeller 110 from striking or contacting the housing 112.

In some embodiments, impeller 110 is positioned within a housing cavity 134 defined by housing 112. In some such embodiments, housing 112 includes a front panel 120 and a rear panel 130 (e.g., at least partially defining the housing cavity 134). When assembled, the front panel 120 and the rear panel 130 may be spaced apart (e.g., along an axial direction X by the housing cavity 134). Additionally or alternatively, impeller 110 may be placed in mechanical communication with a motor 114 (e.g., provided as or as part of the motor 28) that selectively rotates impeller 110 about an axial direction X within housing 112. For example, impeller 110 may be fixed to a shaft or drive rod 116 of motor 114 such that impeller 110 rotates about the axial direction X within housing 112 with motor 114. In some embodiments, the drive rod 116 extends (e.g., along an axial direction X) from the motor 114 to the impeller 110 through the rear panel 130. Opposite from the drive rod 116, the motor 114 may be in mechanical communication with the drum 26 (e.g., via one or more pulleys, as described above).

As shown, front panel 120 is mounted to rear panel 130 (e.g., via one or more sidewalls positioned about or at least partially defining the housing cavity 134). Front panel 120 defines an entrance 122 for receiving the flow of air F into housing 112. In some embodiments, rear panel 130 also defines an exhaust exit 136 for directing the flow of air F out of housing cavity 134. As an example, during operation of impeller assembly 100, impeller 110 may rotate on the axial direction X within housing 112 such that impeller 110 draws the flow of air F into housing 112 via entrance 122 of front panel 120. In addition, impeller 110 may urge the flow of air F through rear panel 130 to exhaust exit 136 of housing 112 during operation of impeller assembly 100. In such a manner, impeller 110 may urge or draw the flow of air F through housing 112 during operation of impeller assembly 100.

Figure 4:
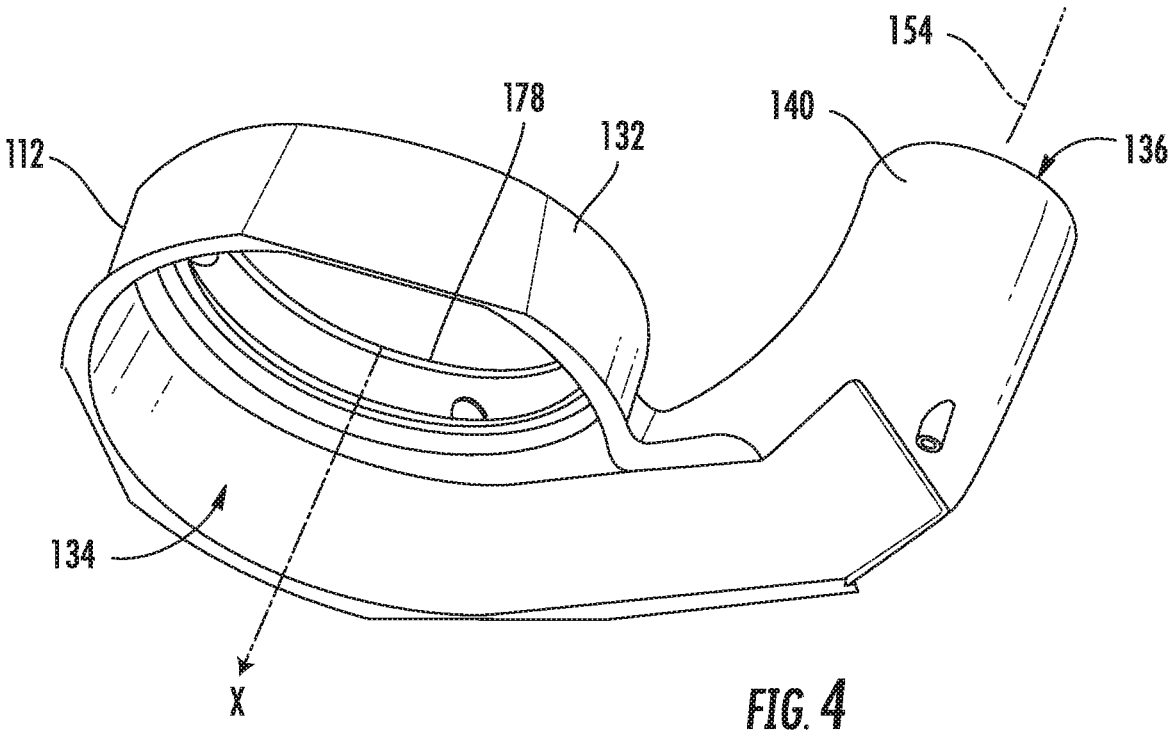
FIG. 4 provides a perspective view of a housing of the exemplary impeller assembly of FIG. 3.
Figure 5:
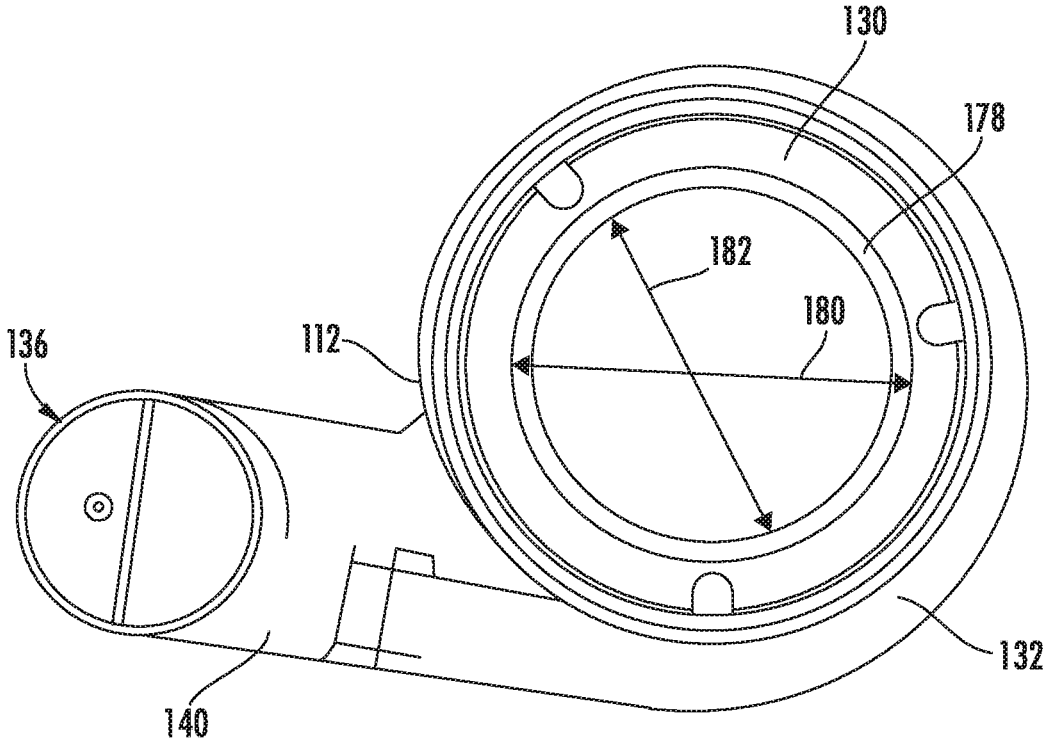
FIG. 5 provides a rear, elevation view of the housing of the exemplary impeller assembly of FIG. 3.
Figure 6:
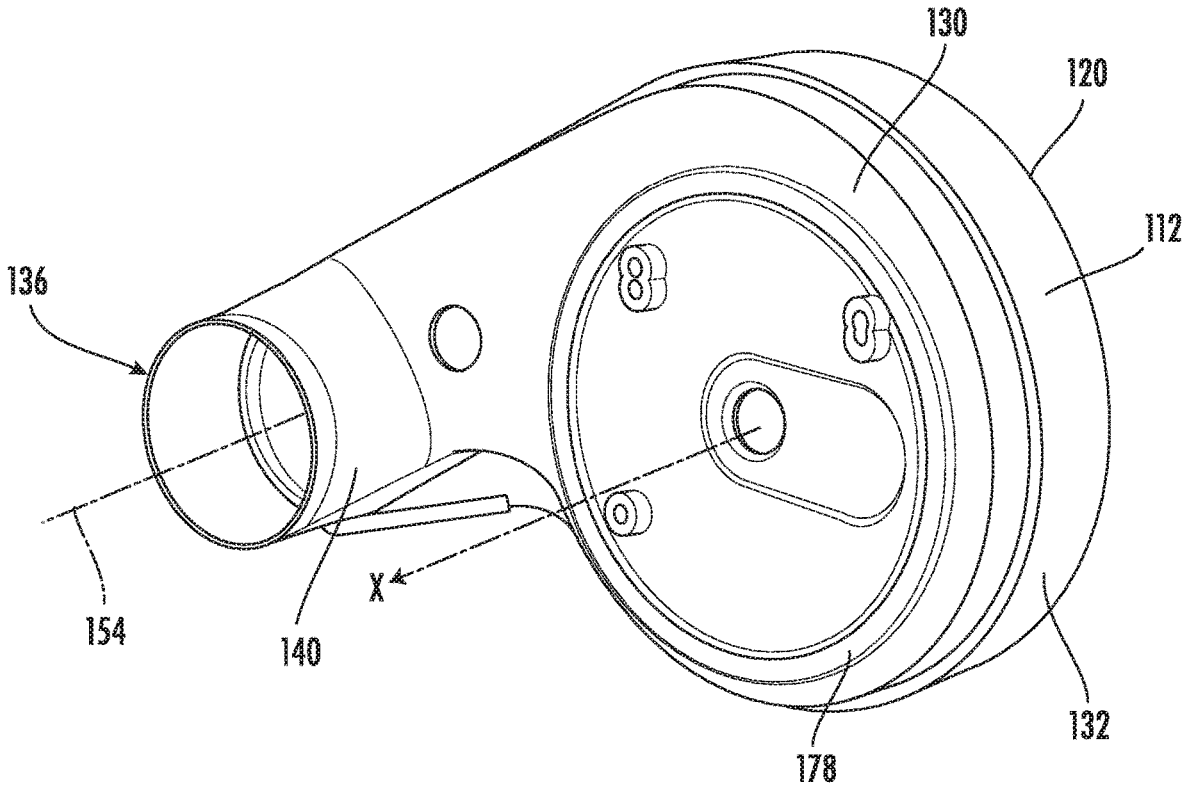
FIG. 6 provides a rear, perspective view of the housing of the exemplary impeller assembly of FIG. 3.
Figure 7:
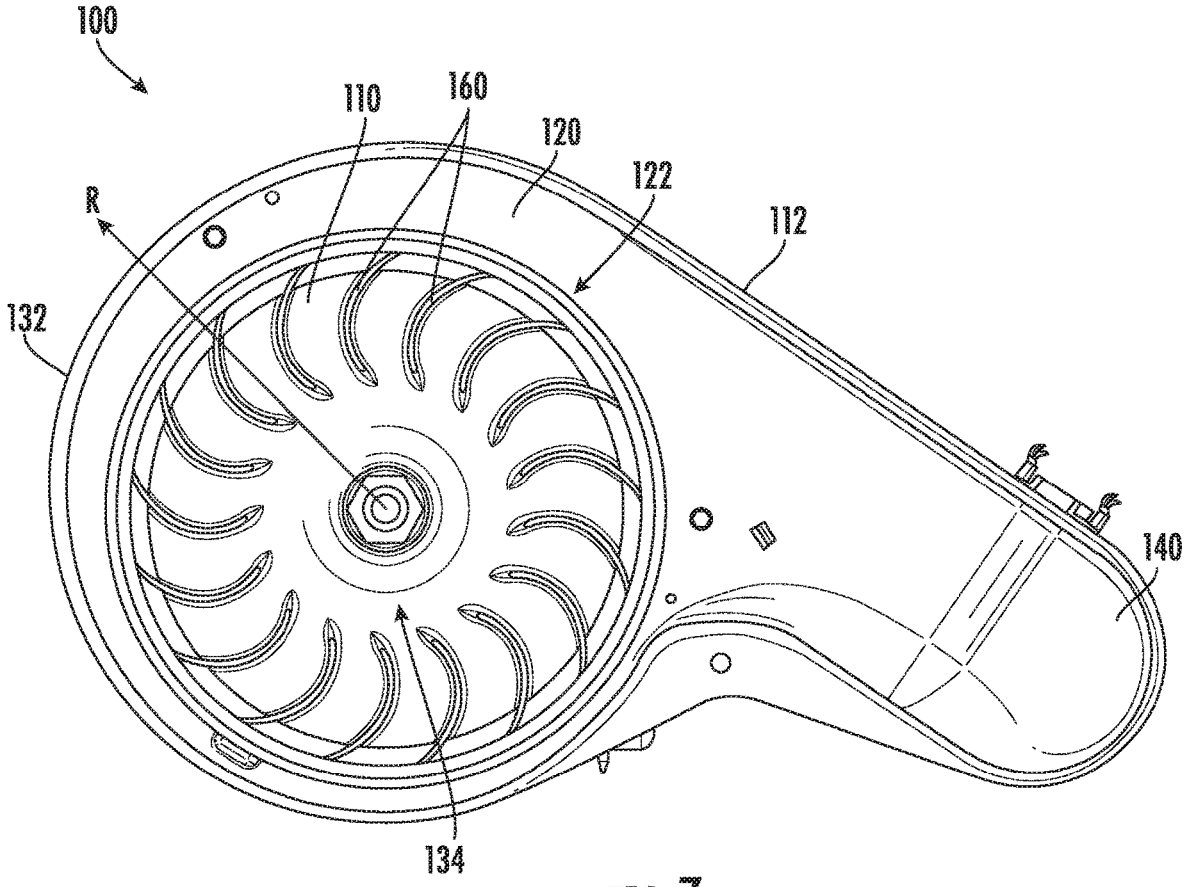
FIG. 7 provides a front, elevation view of the exemplary impeller assembly of FIG. 3.
Figure 8:
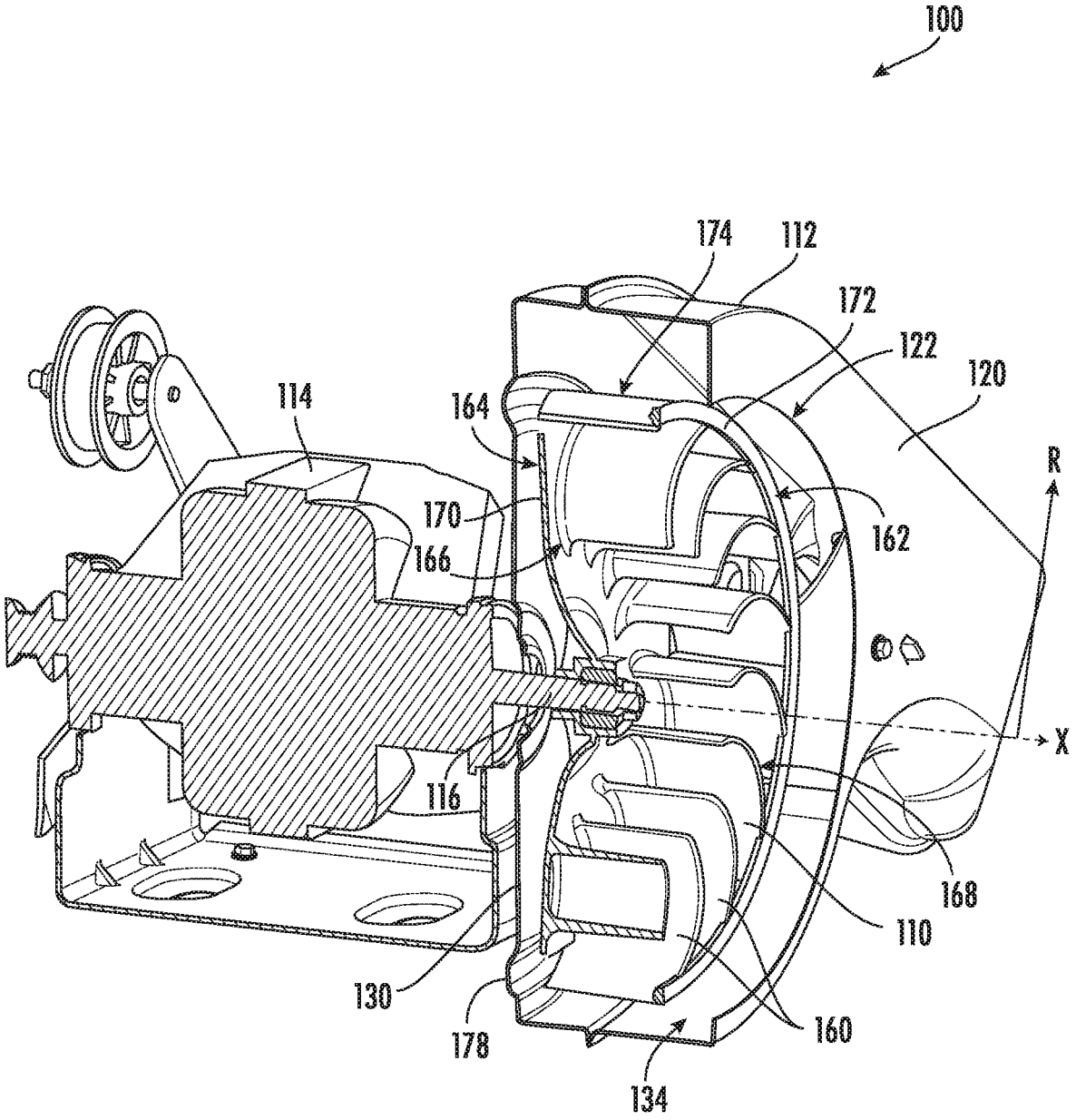
FIG. 8 provides a sectional, perspective view of the exemplary impeller assembly of FIG. 3.
Figure 9:
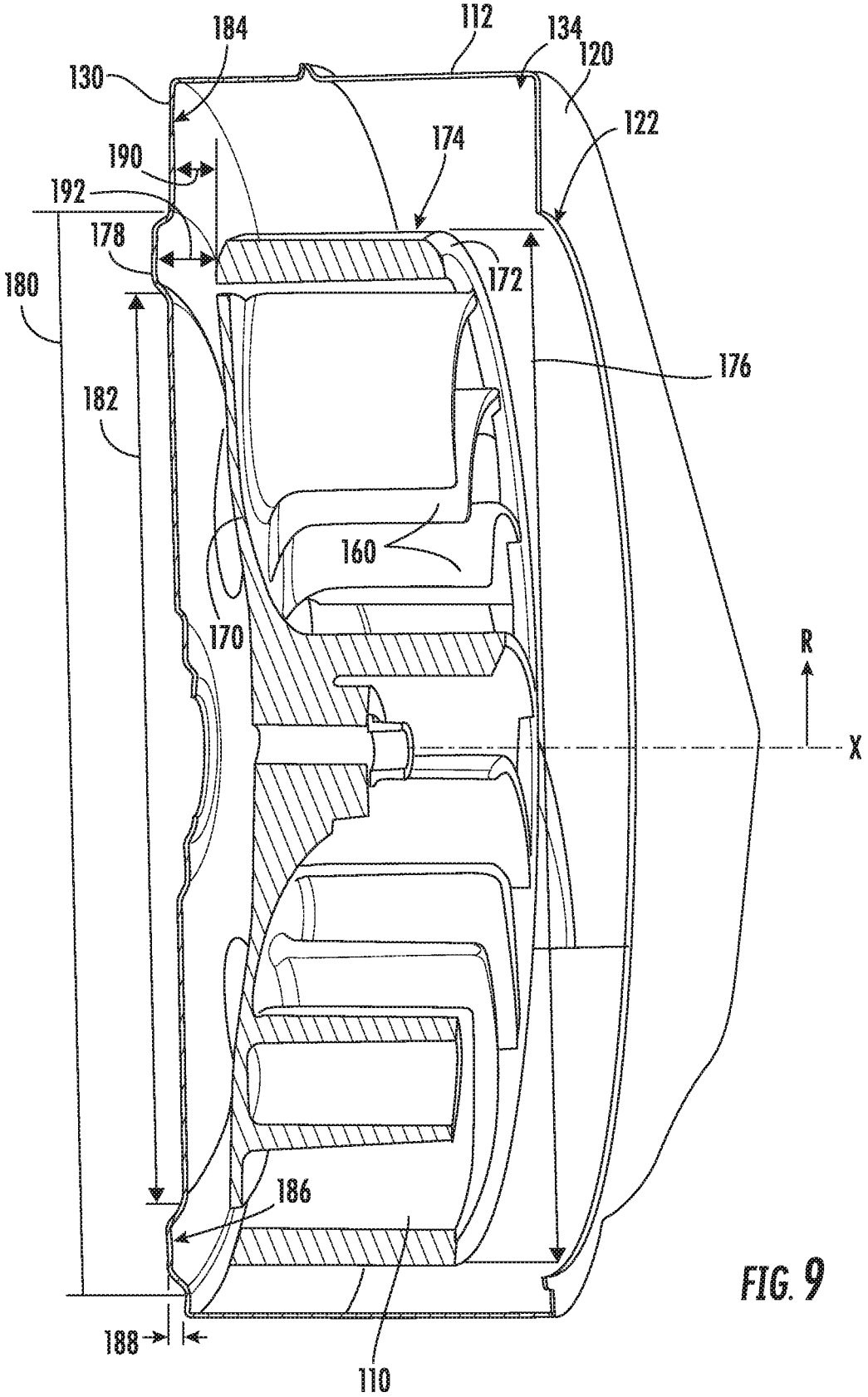
FIG. 9 provides a sectional, perspective view of a portion of the exemplary impeller assembly of FIG. 3.

Turning now to FIGS. 4 through 6, various views are provided of housing 112. In some embodiments, housing 112 includes a cylindrical portion 132 and a transition duct 140. Cylindrical portion 132 defines a portion of housing cavity 134 (e.g., as a volute) of housing 112 that is sized and configured for receiving impeller 110. Thus, impeller 110 may be positioned within cylindrical portion 132 (e.g., at the volute portion of housing cavity 134). Transition duct 140 extends between cavity 134 of cylindrical portion 132 and exhaust exit 136 (e.g., in an L-shape). Exhaust exit 136 defines an exit axis 154. The flow of air F exits housing 112 at exhaust conduit 136 flowing along a direction that is parallel to exit axis 154. In optional embodiments, exit axis 154 is substantially parallel to the axial direction X. The flow of air F may flow into housing 112, flowing along a direction that is parallel to the axial direction X. Within cavity 134 of cylindrical portion 132, the flow of air F may be urged radially outward from the axial direction X (e.g., perpendicular to the axial direction X). Transition duct 140 may redirect or turn the flow of air F within housing 112 (e.g., such that the flow of air F enters and exits housing 112 along directions that are parallel to each other).

As discussed above, housing 112 may be positioned within cabinet 12 of dryer appliance 10. As an example, housing 112 may be positioned within cabinet 12 at front duct 42. Entrance 122 of front panel 120 may be positioned for receiving moisture laden air $A_m$ from front duct 42. In addition, front panel 120 (FIG. 3) may be mounted to cylindrical portion 132 and positioned over the volute of housing cavity 134. Entrance 122 of front panel 120 may also be positioned for directing the flow of air F into cavity 134 of cylindrical portion 132. The flow of air F flows through housing 112 from cavity 134 of cylindrical portion 132 to exhaust exit 136. From exhaust exit 136, the flow of air F exits housing 112. In dryer appliance 10, exhaust duct 48 may extend between and fluidly couple exhaust exit 136 of housing 112 and vent 49 of cabinet 12.

Housing 112 may be constructed of or with any suitable material. For example, housing 112 may be constructed of or with a single continuous or integral piece of plastic. In particular, cylindrical portion 132 of housing 112 and transition duct 140 of housing 112 may be constructed of a single continuous or integral piece of plastic.

Figure 10:
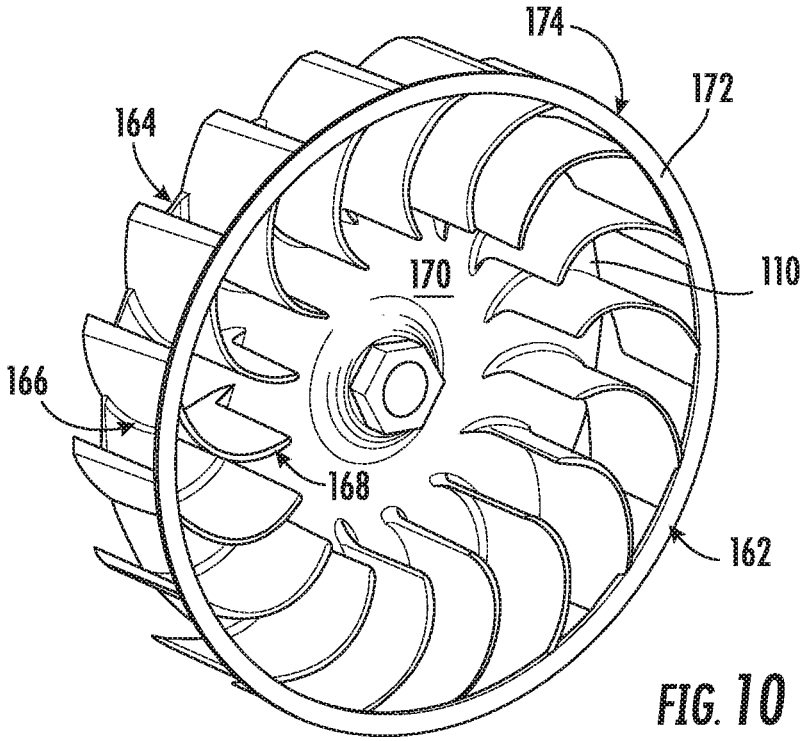
FIG. 10 provides a front, perspective view of the impeller of the exemplary impeller assembly of FIG. 3.
Figure 11:
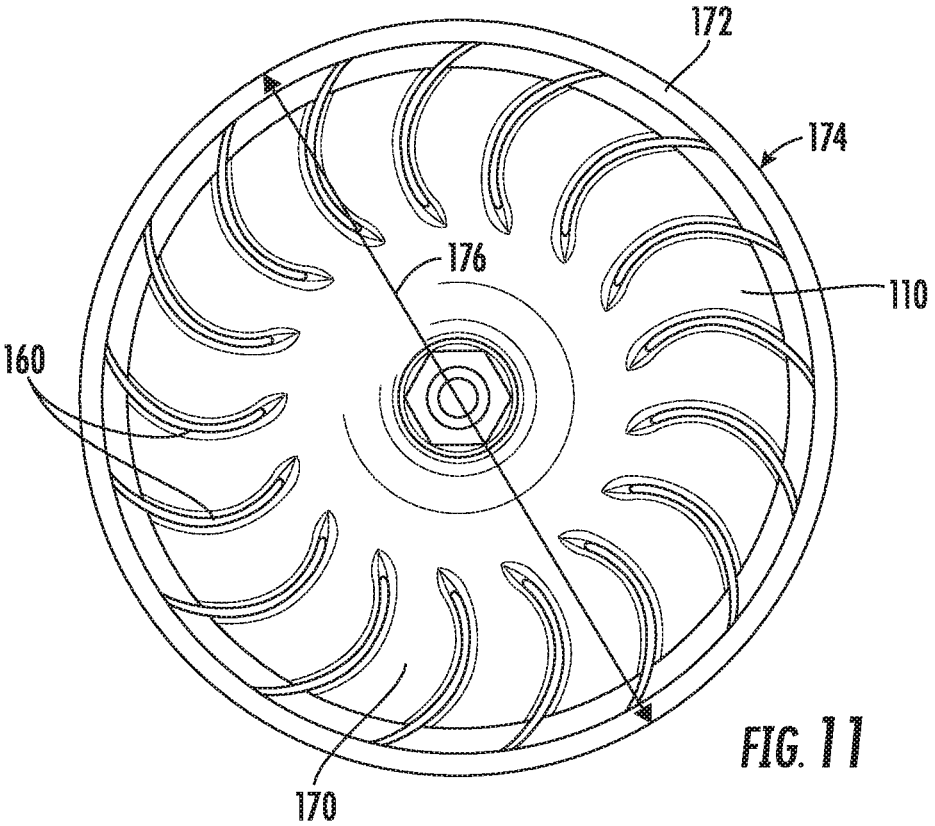
FIG. 11 provides a front, elevation view of the impeller of the exemplary impeller assembly of FIG. 3.

Turning now to FIGS. 6 through 11, FIGS. 7 through 9 provide various views of impeller assembly 100 while FIGS. 10 and 11 provide various views of impeller 110 in isolation.

As noted above, in exemplary embodiments, the impeller 110 is a centrifugal impeller 110 configured to rotate about the axial direction X. Multiple vanes 160 may be provided on the impeller 110 and may extend generally outward in or along a radial direction R that is perpendicular to the axial direction X. For example, the vanes 160 may extend parallel to the radial direction R or, alternatively, along a generally-radial arcuate path (as shown). In optional embodiments, the impeller 110 has an open face 162 (e.g., directed toward the front panel 120 or entrance 122) and a closed face 164 (e.g., directed toward the rear plate 130). As shown, the vanes 160 may thus extend axially from a supported end 166 at the closed face 164 to a free end 168 at the open face 162. In other words, the vanes 160 may be formed on or attached to baseplate 170 defining the closed face 164 while being at least partially unsupported or uncovered at the open face 162. Although the vanes 160 may be unsupported or uncovered at the open face 162, a bracing rim 172 may extend across the vanes 160 at the free end 168 (e.g., across less than 80% of the area of the circular profile of the impeller 110 at the open face 162) in order to maintain rigidity and circumferential spacing between the vanes 160. When assembled, the open face 162 may be positioned proximal to the front panel 120 and distal to the rear panel 130, while the closed face 164 is proximal to the rear panel 130 and distal to the front panel 120. Thus, as the impeller 110 rotates, air may be drawn axially toward the open face 162 before being directed radially outward at or across the closed face 164.

In exemplary embodiments, the impeller 110 has or defines a circular perimeter 174. The impeller 110 may thus provide a generally circular profile (e.g., as defined on a plane perpendicular to the axial direction X). Across the circular perimeter 174 (e.g., perpendicular to the axial direction X), the impeller 110 extends to an outer impeller diameter 176. As shown, the outer impeller diameter 176 may be defined as a radially-outermost portion of the impeller 110 (e.g., outermost as measured from the axial direction X). In some such embodiments, the outer impeller diameter 176 is defined at a radial tip or perimeter of the vanes 160 or closed face 164.

As shown, a circular groove 178 is generally defined on a portion of rear plate 130. In particular, the circular groove 178 extends rearward from the housing cavity 134 (e.g., at the volute portion thereof) along an outer groove diameter 180. Thus, the circular groove 178 may provide a recess or expanded area within the housing cavity 134. In some embodiments, the circular groove 178 extends from an interior planar surface 184, which faces the housing cavity 134. For example, the circular groove 178 may define a maximum groove depth 188 (e.g., parallel to the axial direction X) from an interior planar surface 184 of the rear panel 130 to a base surface 186 (e.g., rearward-most interior surface) of the circular groove 178. From the area outside of the housing cavity 134 (e.g., opposite the interior planar surface 184), the circular groove 178 may appear as an embossing or raised portion.

As shown, the circular groove 178 defines an outer groove diameter 180 at the radially-outermost portion of the circular groove 178 (e.g., outermost as measured from the axial direction X). In some embodiments, an inner groove diameter 182 is further defined at the radially-innermost portion of the circular groove 178 (e.g., innermost as measured from the axial direction X). Specifically, the inner groove diameter 182 may be defined about the axial direction X and concentrically with respect to the outer groove diameter 180. In other words, the inner groove diameter 182 may be concentric with the outer groove diameter 180. Together, the outer groove diameter 180 and the inner groove diameter 182 may define a groove profile (e.g., between the inner groove diameter 182 and the outer groove diameter 180 when viewed in a plane parallel to the axial direction X), which would define the maximum groove depth 188. It is noted that although the circular groove 178 is illustrated as having a semi-circular groove 178 profile, another suitable groove profile may be provided, such as a square profile, acme profile, Whitworth profile, etc.

When assembled, the circular groove 178 is concentrically aligned with the circumferential perimeter of the impeller 110. For instance, the impeller 110 may be generally positioned radially inward from the outer groove diameter 180. In other words, relative to the radial direction R, the outer groove diameter 180 may be located further outward than the outer impeller diameter 176. Thus, the outer groove diameter 180 may be greater than the outer impeller diameter 176. In exemplary embodiments, the outer groove diameter 180 is at least two percent (2%) greater than the outer impeller diameter 176. In additional or alternative embodiments, the outer groove is no more than ten percent (10%) greater than the outer impeller diameter 176. In optional embodiments, the outer groove diameter 180 is between two to ten percent (2%-10%) greater than the outer impeller diameter 176. In further exemplary embodiments, the outer groove diameter 180 is at least three percent (3%) greater than the outer impeller diameter 176. In further additional or alternative embodiments, the outer groove is no more than five percent (5%) greater than the outer impeller diameter 176. In further optional embodiments, the outer groove diameter 180 is between three to five percent (3%-5%) greater than the outer impeller diameter 176.

Along with being smaller than the outer groove diameter 180, the outer impeller diameter 176 may be larger or greater than the inner groove diameter 182. Thus, the outer impeller diameter 176 radially positioned between the inner groove diameter 182 and the outer groove diameter 180. In exemplary embodiments, the inner groove diameter 182 is at least five percent (5%) smaller than the outer impeller diameter 176. In additional or alternative embodiments, the inner groove is no more than twenty percent (20%) smaller than the outer impeller diameter 176. In optional embodiments, the inner groove diameter 182 is between five to twenty percent (5%-20%) smaller than the outer impeller diameter 176. In further exemplary embodiments, the inner groove diameter 182 is at least ten percent (10%) smaller than the outer impeller diameter 176. In further additional or alternative embodiments, the inner groove diameter 182 is no more than fifteen percent (15%) smaller than the outer impeller diameter 176. In further optional embodiments, the inner groove diameter 182 is between ten to fifteen percent (10%-15%) smaller than the outer impeller diameter 176.

Along with being positioned radially inward from the outer groove diameter 180, the impeller 110 may be axially-spaced from the rear plate 130. In other words, a gap or space may be defined along (e.g., parallel to) the axial direction X between the impeller 110 and the rear plate 130. In some embodiments, the axial distance between the impeller 110 (e.g., at the circular perimeter 174) and the circular groove 178 (e.g., at the base surface 186 or maximum groove depth 188) is greater than the axial distance between the impeller 110 and the portion of the rear plate 130 surrounding the circular groove 178. For instance, a first axial distance 190 may defined between the impeller 110 (e.g., at the circular perimeter 174) and the interior planar surface 184, while a second axial distance 192 that is greater than the first axial distance 190 is defined between the impeller 110 (e.g., at the circular perimeter 174) and the maximum groove depth 188. In some such embodiments, the second axial distance 192 is greater than or equal to one hundred twenty-five percent (125%) of the first axial distance 190. Optionally, the second axial distance 192 is between one hundred twenty-five percent and one hundred fifty percent (125%-150%) of the first axial distance 190.

Advantageously, impeller assemblies, as described herein may be able to handle relatively large deflections of a motor shaft, such as those caused by transitory torque demands (e.g., perpendicular to the axial direction, as could be caused by simultaneous motivation of a drum and impeller) without having an impeller strike or contact an interior surface of a housing thereof. Moreover, the disclosed subject matter may advantageously provide an impeller that can be closely mounted against (e.g., in close proximity to) a portion of the housing, thereby preventing efficiency loses that may be caused by an oversized housing cavity.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining a vent;

a drum rotatably mounted within the cabinet, the drum defining a chamber for receipt of articles for drying;

a motor mounted within the cabinet;

an impeller in mechanical communication with the motor to motivate rotation of the impeller about an axial direction, the impeller being rotatable about the axial direction to urge a flow of air from the chamber of the drum to the vent of the cabinet, the impeller defining a circumferential perimeter about the axial direction; and a housing positioned within the cabinet, the housing comprising a front panel and a rear panel, the front panel and the rear panel being spaced apart along the axial direction by a housing cavity within which the impeller is positioned, the front panel defining an entrance upstream of the impeller to permit air therethrough, the rear panel defining a circular groove extending rearward from the housing cavity and concentrically aligned with the circumferential perimeter of the impeller, wherein the circular groove defines an inner groove diameter and an outer groove diameter radially positioned outward from the inner groove diameter, and wherein the impeller defines an outer impeller diameter radially positioned between the inner groove diameter and the outer groove diameter.

2. The dryer appliance of claim 1, wherein the impeller is a centrifugal impeller.

3. The dryer appliance of claim 2, wherein the impeller has an open face and a closed face, wherein the impeller comprises a plurality of vanes extending axially from a supported end at the closed face to a free end at the open face, wherein the open face is proximal to the front panel and distal to the rear panel, and wherein the closed face is proximal to the rear panel and distal to the front panel.

4. The dryer appliance of claim 1, wherein the outer groove diameter is greater than the outer impeller diameter.

5. The dryer appliance of claim 4, wherein the outer groove diameter is two to ten percent greater than the outer impeller diameter.

6. The dryer appliance of claim 1, wherein the circular groove defines a maximum groove depth parallel to the axial direction from an interior planar surface of the rear panel to a base surface of the circular groove.

7. The dryer appliance of claim 6, wherein a first axial distance is defined between the impeller and the interior planar surface, wherein a second axial distance is defined between the impeller and the base surface of the circular groove, and wherein the second axial distance is greater than or equal to one hundred twenty-five percent of the first axial distance.

8. The dryer appliance of claim 1, further comprising an exhaust duct downstream of the housing, wherein the housing cavity defines a volute, wherein the housing comprises a transition duct extending between the volute and an exhaust exit of the housing, wherein the impeller is positioned within the housing at the volute of the housing, and wherein the exhaust duct extends between the exhaust exit of the housing and the vent of the cabinet.

9. The dryer appliance of claim 1, wherein the motor is further in mechanical communication with the drum to motivate rotation thereof.

10. A ventilation assembly for a dryer appliance, the ventilation assembly comprising:

a motor;

an impeller in mechanical communication with the motor to motivate rotation of the impeller about an axial direction, the impeller being rotatable about the axial direction to urge a flow of air from a drum of the dryer appliance, the impeller defining a circumferential perimeter about the axial direction; and a housing comprising a front panel and a rear panel, the front panel and the rear panel being spaced apart along the axial direction by a housing cavity within which the impeller is positioned, the front panel defining an entrance upstream of the impeller to permit air therethrough, the rear panel defining a circular groove extending rearward from the housing cavity and concentrically aligned with the circumferential perimeter of the impeller, wherein the circular groove defines an inner groove diameter and an outer groove diameter radially positioned outward from the inner groove diameter, and wherein the impeller defines an outer impeller diameter radially positioned between the inner groove diameter and the outer groove diameter.

11. The ventilation assembly of claim 10, wherein the impeller is a centrifugal impeller, wherein the impeller has an open face and a closed face, wherein the impeller comprises a plurality of vanes extending axially from a supported end at the closed face to a free end at the open face, wherein the open face is proximal to the front panel and distal to the rear panel, and wherein the closed face is proximal to the rear panel and distal to the front panel.

12. The ventilation assembly of claim 10, wherein the outer groove diameter is greater than the outer impeller diameter.

13. The ventilation assembly of claim 12, wherein the outer groove diameter is two to ten percent greater than the outer impeller diameter.

14. The ventilation assembly of claim 10, wherein the circular groove defines a maximum groove depth parallel to the axial direction from an interior planar surface of the rear panel to a base surface of the circular groove.

15. The ventilation assembly of claim 14, wherein a first axial distance is defined between the impeller and the interior planar surface, wherein a second axial distance is defined between the impeller and the base surface of the circular groove, and wherein the second axial distance is greater than or equal to one hundred twenty-five percent of the first axial distance.

16. The ventilation assembly of claim 10, wherein the housing cavity defines a volute, wherein the housing comprises a transition duct extending between the volute and an exhaust exit of the housing, wherein the impeller is positioned within the housing at the volute of the housing.

17. A dryer appliance, comprising:

a cabinet defining a vent;

a drum rotatably mounted within the cabinet, the drum defining a chamber for receipt of articles for drying;

a motor mounted within the cabinet in mechanical communication with the drum to motivate rotation thereof;

an impeller in mechanical communication with the motor to motivate rotation of the impeller about an axial direction, the impeller being rotatable about the axial direction to urge a flow of air from the chamber of the drum to the vent of the cabinet, the impeller defining a circumferential perimeter about the axial direction; and a housing positioned within the cabinet, the housing comprising a front panel and a rear panel, the front panel and the rear panel being spaced apart along the axial direction by a housing cavity within which the impeller is positioned, the front panel defining an entrance upstream of the impeller to permit air therethrough, the rear panel defining a circular groove extending rearward from the housing cavity and concentrically aligned with the circumferential perimeter of the impeller, wherein the impeller is a centrifugal impeller, wherein the circular groove defines a maximum groove depth parallel to the axial direction from an interior planar surface of the rear panel to a base surface of the circular groove, and wherein the impeller defines an outer impeller diameter radially positioned between the inner groove diameter and the outer groove diameter.

* * * * *